US005083673A

United States Patent [19]

Fossey

[11] Patent Number: 5,083,673

[45] Date of Patent: Jan. 28, 1992

[54] CONTAINER TANK

[75] Inventor: Robin E. Fossey, Redhills, Ireland

[73] Assignee: Container Design Limited, Clones, Ireland

[21] Appl. No.: 605,223

[22] Filed: Oct. 24, 1990

[30] Foreign Application Priority Data

Oct. 27, 1989 [IE] Ireland ..... 3468/89

[51] Int. Cl.[5] ..... B65D 88/06

[52] U.S. Cl. ..... 220/1.5; 220/4.12; 220/401

[58] Field of Search ..... 220/401, 1.5, 562, 4.12

[56] References Cited

U.S. PATENT DOCUMENTS

| | | | |
|---|---|---|---|
| 3,971,491 | 7/1976 | Mowatt-Larssen | 220/1.5 X |
| 4,307,812 | 12/1981 | Gerhard | 220/1.5 |
| 4,412,626 | 11/1983 | Gerhard | 220/1.5 |
| 4,469,236 | 9/1984 | Marsault et al. | 220/401 X |
| 4,593,032 | 6/1986 | Gerhard | 220/1.5 |
| 4,753,363 | 6/1988 | Gerhard | 220/4.12 X |
| 4,955,956 | 9/1990 | Gerhard | 220/562 |

FOREIGN PATENT DOCUMENTS

| | | |
|---|---|---|
| 2013624 | 8/1979 | United Kingdom . |
| 2024166 | 1/1980 | United Kingdom . |
| 2168415 | 6/1986 | United Kingdom . |

*Primary Examiner*—Steven M. Pollard

*Attorney, Agent, or Firm*—Laubscher, Presta & Laubscher

[57] ABSTRACT

A container tank comprises a tank mounted between a pair of end frames by upper bearer members and lower bearer members. The tank comprises a cylindrical shell closed by end caps. Each upper bearer member comprises a bearer plate of arcuate partly circular transverse cross section which is similar to the cross section of the central shell of the tank. Each bearer plate terminates in a transverse tank engaging edge which is seam welded to the cylindrical shell of the tank and a transverse frame engaging edge which is seam welded to an upper connecting member of the end frames.

9 Claims, 6 Drawing Sheets

CONTAINER TANK

FIELD OF THE INVENTION

The present invention relates to a container tank of the type generally used for the transportation of bulk liquids and other bulk materials with fluid like characteristics.

BACKGROUND TO THE INVENTION

In general, such container tanks are constructed to ISO standards and comprise a pair of transversely mounted end frames with a tank mounted between the end frames. In general, the tank has a central shell of either circular, elliptical or ovoid cross section closed by end caps. The end caps, in general, are dished and are convex when viewed externally. The end frames, in general, comprise a pair of upstanding spaced apart side members joined by top and bottom cross members, the side, top and bottom members in general terminate in corner castings which are constructed to ISO standards and in general comprise openings to facilitate handling and stacking of the container tanks. Inclined connecting members extending between the side and top and bottom members adjacent the corners of the end frames are provided for mounting the tank to the end frames. Bearer members extend from the tank to the end frames for mounting the tank to the end frames. In general, four bearer members are provided extending from each end of the tank to engage the adjacent end frame. The bearer members, in general, are provided at positions of 45° intermediate a central horizontal and central vertical plane of the tank.

A typical construction of container tank which comprises a pair of end frames and a tank mounted to the end frame by bearer members is described and illustrated in British Patent Application Specification No. 2,168,415A.

While such container tanks, in general, are adequate for the transportation of bulk materials or liquids, they tend to be relatively heavy and thus transportation and handling of such container tanks tends to be relatively inefficient. By virtue of the construction of these container tanks, the tank acts as an integral part of the structure, and furthermore, the bearer members are structural members of the container tank. Because of this, the bearer members must be of sufficient size and construction to carry the loads to which they are subjected. Thus, in general, the bearer members of such tanks are of relatively robust construction and large cross sectional area. This, needless to say, adds significantly to the weight of the container tank, which thus leads to inefficiencies in the transportation and handling of such container tanks.

OBJECTS OF THE INVENTION

One object of the invention is to provide a container tank which is relatively lightweight, while at the same time is of adequate strength and rigidity. Another object of the invention is to provide a container tank that can be more easily and efficiently handled than container tanks known heretofore. A further object of the invention is to provide a container tank which is relatively more easily and efficiently transported than container tanks known heretofore. A further object of the invention is to provide a container tank which can readily easily be constructed. Another object of the invention is to provide a container tank of relatively simple construction.

SUMMARY OF THE INVENTION

According to the invention, there is provided a container tank comprising a tank, the tank comprising a central shell defining a central longitudinal axis, a pair of end caps closing respective ends of the central shell, at least one end frame extending transversely of the longitudinal axis adjacent one of the end caps, and mounting means for mounting the tank to the end frame, the mounting means comprising at least one bearer plate of plate material extending in a generally longitudinal direction between the tank and the end frame, and having a tank engaging end and a frame engaging end, the tank engaging end being formed by a transverse tank engaging edge extending transversely of the bearer plate, and the frame engaging end being formed by a frame engaging edge extending transversely of the bearer plate, the bearer plate extending longitudinally between the tank engaging and frame engaging edges, and the bearer plate being of bent transverse cross section at least adjacent the tank engaging edge.

In one embodiment of the invention, the bent portion of the bearer plate is of arcuate shape.

In another embodiment of the invention, the bearer plate is arcuate along the entire longitudinal length of the bearer plate between the tank and frame engaging edges. Preferably, the bearer plate is of constant curvature over the entire length thereof.

Preferably, the bearer plate extends longitudinally from the central shell of the tank adjacent an end cap thereof, and advantageously, the curvature of the bearer plate is substantially identical to the curvature of the central shell of the tank adjacent the bearer member.

In a further embodiment of the invention, the tank engaging edge of the bearer plate is longer than the frame engaging edge, and the tank engaging edge and frame engaging edges are joined by longitudinal side edges converging toward the frame engaging edge. Advantageously, each longitudinal side edge of the bearer plate comprises a convex portion extending from the tank engaging edge towards a concave portion of the longitudinal side edge extending from the frame engaging edge.

In another embodiment of the invention, the tank engaging edge of the bearer plate is seam welded over substantially its entire length to the tank, and the frame engaging edge is seam welded over substantially its entire length to the end frame.

In a further embodiment of the invention, a pair of end frames are provided extending transversely of the central longitudinal axis of the tank, the tank being mounted between the two end frames, and the tank being mounted to the end frames by respective bearer plates.

In a further embodiment of the invention, the tank is mounted to each end frame by a pair of bearer plates, the bearer plates being positioned on the tank at positions substantially halfway between a central horizontal plane and central vertical plane of the tank, the tank engaging edge of each bearer plate extending on each side of a 45° position intermediate the said central planes, respectively, towards the horizontal plane and the vertical plane.

Advantageously, the axis defined by the curvature of each bearer plate co-incides with the central longitudinal axis of the tank.

In another embodiment of the invention, the central shell of the tank is of circular cross section and each bearer plate is of partly circular transverse cross section.

ADVANTAGES OF THE INVENTION

The advantages of the invention are many. The container tank according to the invention is relatively lightweight, and is also of relatively strong and rigid construction. By virtue of the fact that the bearer plate is of plate material, the bearer plate is of relatively light weight. By virtue of the fact that the bearer plate is of bent transverse cross section, the bearer plate is relatively strong and when mounting the tank to the end frame provides a relatively strong and rigid construction of container tank. Where the bearer plate is of arcuate transverse cross section, a bearer plate of greater strength is provided, and accordingly, this further facilitates the provision of a relatively lightweight container tank while at the same time providing a container tank which is relatively strong and rigid. Where the curvature of the transverse cross section of the bearer plate is substantially similar to the curvature of the central shell of the tank, this further enhances the strength of the bearer plate and in particular the strength and rigidity of the combined tank and end frames. Where at least two bearer plates are provided for mounting the tank to an adjacent end frame, a tank of greater strength and rigidity is provided and this further facilitates in providing a tank of relatively light weight.

Another of the many advantages of the invention is that the container tank according to the invention is of relatively simple construction and can be manufactured and produced relatively simply and easily and at relatively low cost.

These and other advantages and objects of the invention will be readily apparent to those skilled in the art from the following description of some preferred embodiments thereof, which are given by way of example only, with reference to the accompanying drawings.

DETAILED DESCRIPTION OF THE INVENTION

Figure 1:
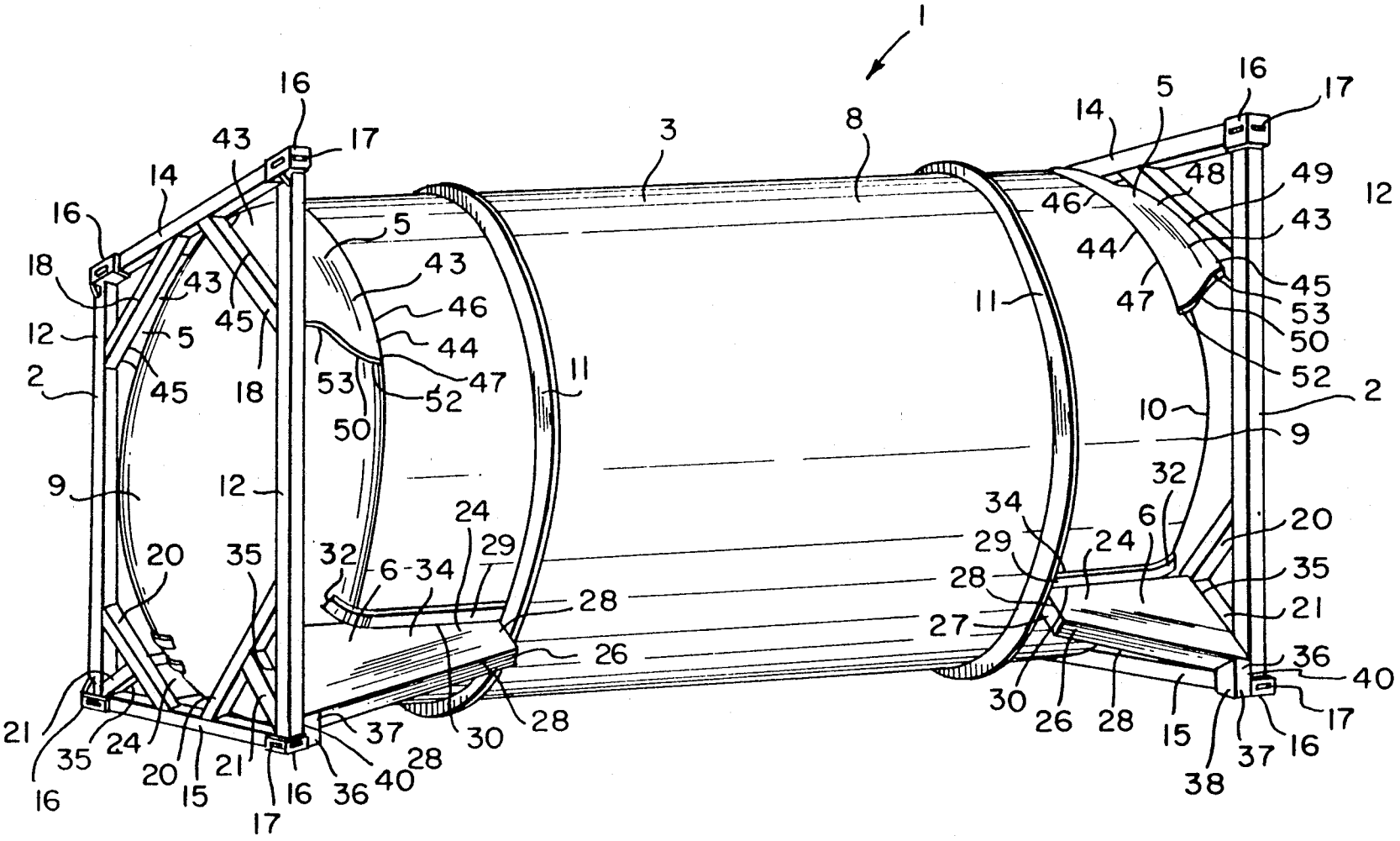
FIG. 1 is a perspective view of a container tank according to the invention.
Figure 2:
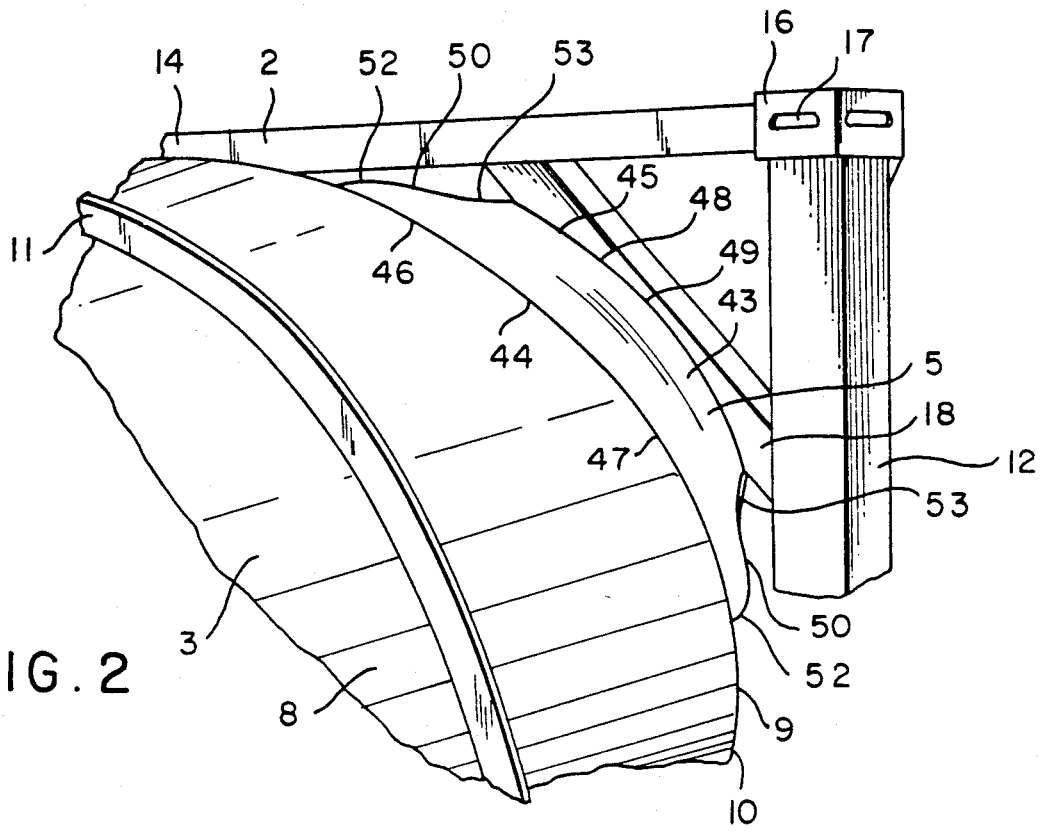
FIG. 2 is a perspective view of a detail of the container tank of FIG. 1.
Figure 8:
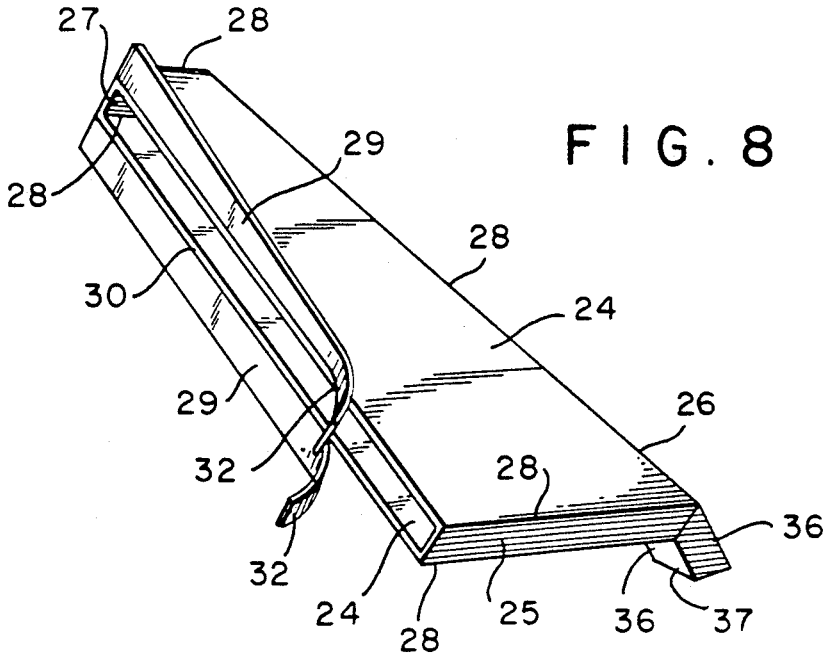
FIG. 8 is a perspective view of a further detail of the container tank of FIG. 1.

Referring to the drawings and initially to FIGS. 1 to 8, there is illustrated a container tank according to the invention indicated generally by the reference numeral 1. The container tank 1 is constructed to ISO standards. The container tank 1 comprises a pair of transverse end frames 2 and a tank 3 mounted between the end frames 2 by mounting means comprising four upper bearer members 5 and four lower bearer members 6, both of which will be described in more detail below. The tank 3 is of stainless steel material and comprises a central cylindrical shell 8 defining a central longitudinal axis 7. A pair of end caps 9 close the ends of the cylindrical shell 8. The end caps 9 are of dished shape and are convex when viewed from the exterior of the tank 3. The end caps 9 are seam welded to the cylindrical shell 8 along seam welds 10. A pair of strengthening hoops 11 also of stainless steel material extend around the cylindrical shell 8 of the tank 3 for reinforcing the tank 3 against hoop stresses.

The end frames 2 are arranged transversely of the longitudinal axis 7 of the tank 3. Each end frame 2 comprises a pair of upstanding side members 12 of box section steel joined by top and bottom cross members 14 and 15, respectively, also of box section steel. The side members 12, top and bottom cross members 14 and 15 terminate in and are joined by corner castings 16 which are to ISO standard, and comprise openings 17 to facilitate lifting, stacking, handling and transportation of the container tank 1. Such corner castings 16 will be well known to those skilled in the art. Upper connecting members 18 of box section steel extend between the side members 12 and top cross members 14 for carrying the upper bearer members 5. Lower connecting members 20 extend between the side members 12 and the bottom cross members 15 for carrying the lower bearer members 6. Intermediate connecting members 21 extend from the lower connecting members 20 in a generally diagonal direction towards the corner castings 16 also for carrying the lower bearer members 6.

The lower bearer members 6 are of substantially similar construction to those described and illustrated in British Patent Application Specification No. 2,168,415A. Each lower bearer member 6 comprises a pair of spaced apart side walls 24 of stainless steel plate material joined by end walls 25, 26 and 27 of carbon steel plate material welded to the side walls 24 along seam welds 28. Side flanges 29 of stainless steel plate extend sidewardly from the side walls 24 and are welded thereto along seam welds 30. The side flanges 29 engage the cylindrical shell 8 of the tank 3 and are shaped at 32 to engage the end caps 9 of the tank 3. The lower bearer members 6 are mounted to the tank 3 by welding the side flanges 29 to the cylindrical shell 8 and the end caps 9 along seam welds 34. The lower bearer members 6 are mounted on the end frames 2 by welding the side walls 24 to the intermediate connecting members 21 along seam welds 35. A portion 36 formed by side walls 37 and an end wall 38 which extend downwardly from the side walls 24 and end wall 26, respectively, of the lower bearer members 6 provide further rigidity to the bearer member. Each portion 36 is welded to a corresponding side member 12 of the end frame 2 along a seam weld 40.

Each upper bearer member 5 comprises a bearer plate 43 of stainless steel plate material. The bearer plates 43 extend in a generally longitudinal direction between the tank 3 and the end frames 2 and terminate at respective ends in a tank engaging end 44 and a frame engaging end 45. Each tank engaging end 44 is provided by a transverse tank engaging edge 46 which mounts the bearer plate 43 to the tank 3 and is welded along a seam weld 47 to the tank 3 adjacent the seam weld 10 between the cylindrical shell 8 and the end cap 9. The frame engaging end 45 of each bearer plate 43 is formed by a transverse frame engaging edge 48 which mounts the bearer plate 43 to an adjacent end frame 2 and is welded to an upper connecting member 18 along a seam weld 49. Each bearer plate 43 is of bent transverse cross section when viewed in the direction of the arrow A, see FIGS. 5 and 6, and in this case each bearer plate 43 is of arcuate transverse cross section. The curvature of each bearer plate 43 is identical to the curvature of the cylindrical shell 8 of the tank 3 at the position where the bearer plate is mounted to the cylindrical shell 8. Furthermore, the curvature of each bearer plate 43 is constant over the entire length of each bearer plate 43 from the tank engaging edge 46 to the frame engaging edge 48. Accordingly, the bearer plates 43 are of radius similar to the radius of the cylindrical shell 8 and define an axis which co-incides with the central longitudinal axis 7 of the cylindrical shell 8. Thus, the bearer plates 43 are concave when viewed from the longitudinal axis 7 of the tank 3. The tank engaging edge 46 of each bearer plate 43 is longer than the frame engaging edge 48. The edges 46 and 48 are joined by longitudinal side edges 50. Each side edge 50 extends from the tank engaging edge 46 and is convex at 52 and converges towards the frame engaging edge 48. Each convex portion 52 terminates in a concave portion 53 which extends from the frame engaging edge 48.

Figure 3:
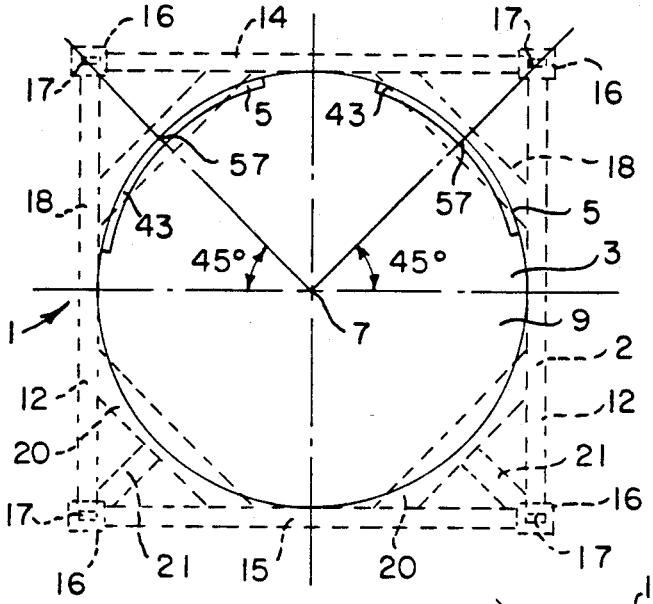
FIG. 3 is an end view of the container tank of FIG. 1 with portion of the container tank shown in broken lines for ease of illustration.
Figure 4:
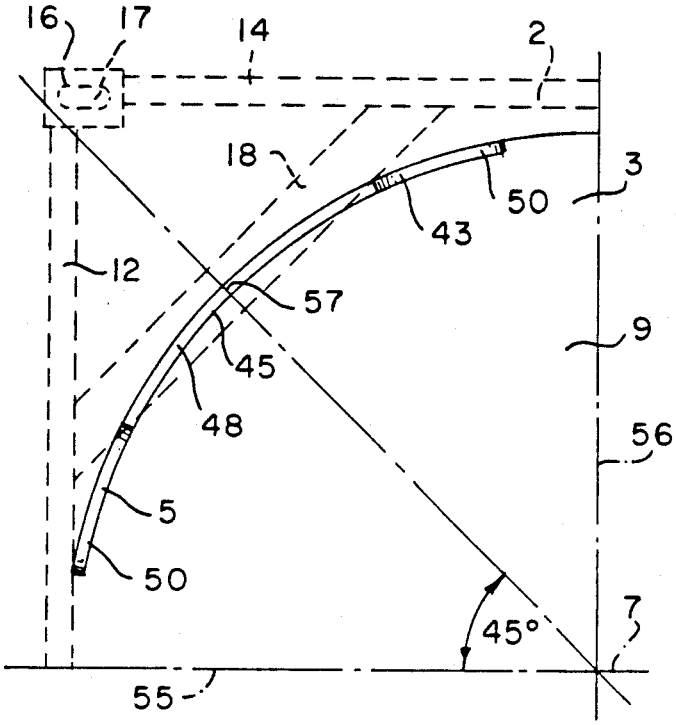
FIG. 4 is an enlarged end view of portion of the container tank of FIG. 1 with portion of the container tank illustrated in broken lines for ease of illustration.
Figure 5:
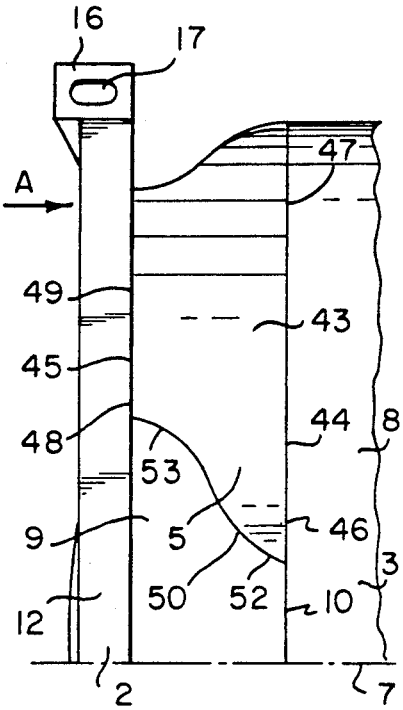
FIG. 5 is a side elevational view of the portion of the container tank of FIG. 4.
Figure 6:
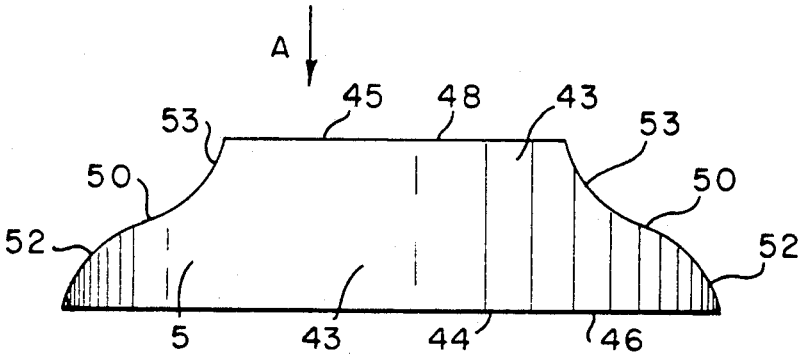
FIG. 6 is a plan view of a detail of the container tank of FIG. 1.
Figure 7:
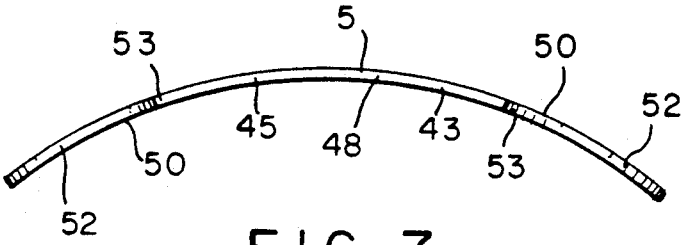
FIG. 7 is an end view of the detail of FIG. 6.

In this embodiment of the invention, the bearer plates 43 engage the tank 3 at positions substantially halfway between a central horizontal plane 55 and a central vertical plane 56 through the tank 3 and above the horizontal plane 55, see FIGS. 3 and 4. The bearer plates 43 extend equidistant on both sides of a 45° position which is indicated by the reference numeral 57 towards the horizontal plane 55 and vertical plane 56.

To construct the container 1 according to the invention, the end frames 2 are positioned at respective ends of the tank 3 transversely of the longitudinal axis 7 of the tank 3. The upper and lower bearer members 5 and 6 are then positioned relative to the end frames 2 and tank 3 ready for welding, and are then welded to the tank 3 and end frames 2.

Figure 10:
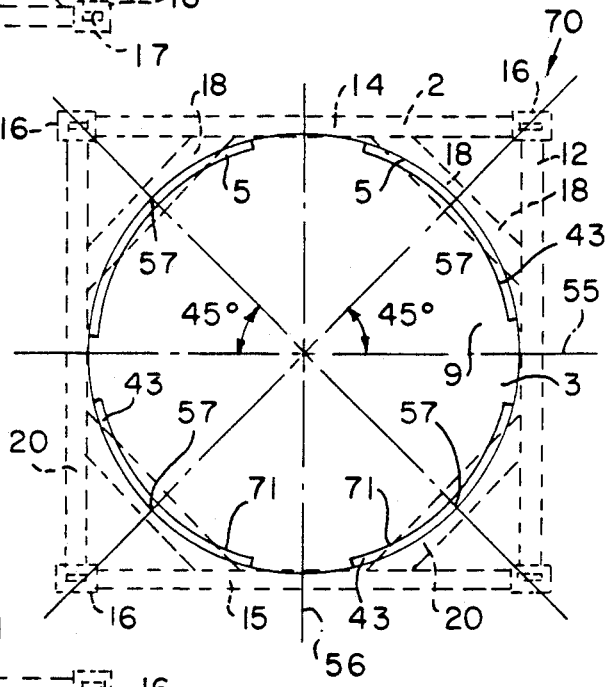
FIG. 10 is an end view similar to FIG. 3 of the container tank of FIG. 9.
Figure 9:
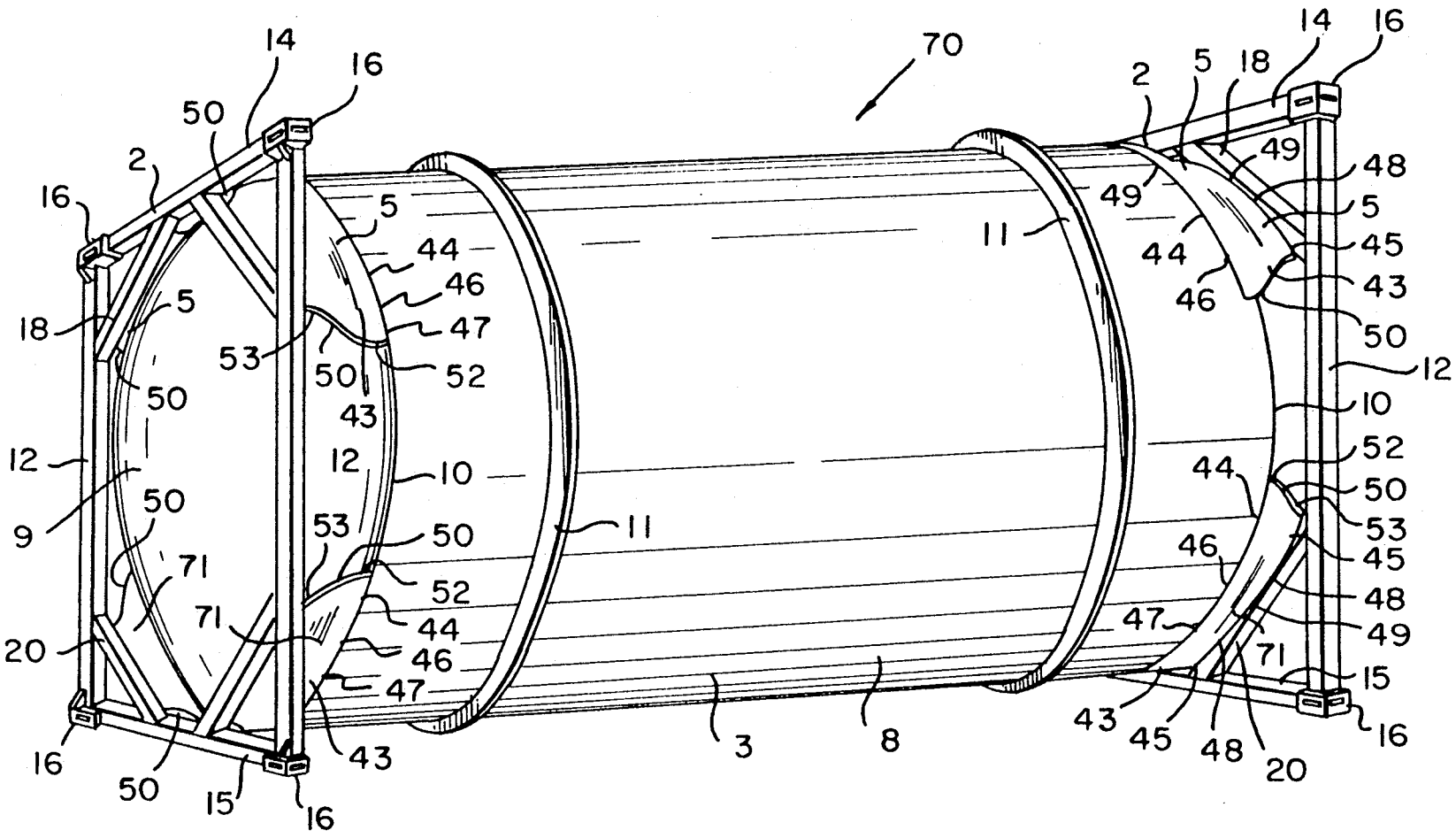
FIG. 9 is a perspective view similar to FIG. 1 of a container tank according to another embodiment of the invention.

The advantages of the container tank 1 according to the invention are many. By mounting the tank 3 to the end frames 2 using the four upper bearer members 5 a relatively strong and rigid container tank 1 is provided, while at the same time the container tank 1 is relatively lightweight. By virtue of the fact that the bearer plates forming the upper bearer members 5 are of bent transverse cross section, and in this case are of arcuate cross section when viewed in the direction of the arrow A, relatively strong and rigid upper bearer members are provided. Needless to say, by virtue of the fact that the upper bearer members are formed by bearer plates, the weight of the bearer members is considerably lower than the lower bearer members 6, and other bearer members known heretofore. This reduction in weight, as mentioned above, has been achieved with virtually no loss of strength or rigidity of the container tank 1. Furthermore, the upper bearer units by virtue of the fact that they are constructed of plate material of arcuate transverse cross section are relatively inexpensive and easy to produce, and are also relatively easy and inexpensive to mount. Referring now to FIGS. 9 and 10 there is illustrated portion of a container tank also according to the invention indicated generally by the reference numeral 70. The container tank 70 is substantially similar to the container tank 1 described with reference to FIGS. 1 to 8 and similar components are identified by the same reference numerals. The main difference between this container tank 70 and the container tank 1 is that the lower bearer members of the container tank 1 are replaced by lower bearer members 71 of identical construction to the upper bearer members 5. In other words, the lower bearer members 71 are formed by bearer plates 43 identical to the bearer plates 43 of the container tank 1. The lower bearer plates 43 are positioned substantially halfway between the central horizontal plane 55 and central vertical plane 56 and below the horizontal plane 55. As can be seen the tank engaging edge 46 of the lower bearer plates 43 extend equi-distant from the 45° position 57 towards the horizontal plane 55 and vertical plane 56. The bearer plates 43 of the bearer members 71 are welded to the lower connecting members 20. The frame engaging edges 48 of the bearer plates 43 of the bearer members 71 are welded along seam welds 49 to the respective lower connecting members 20.

Figure 12:
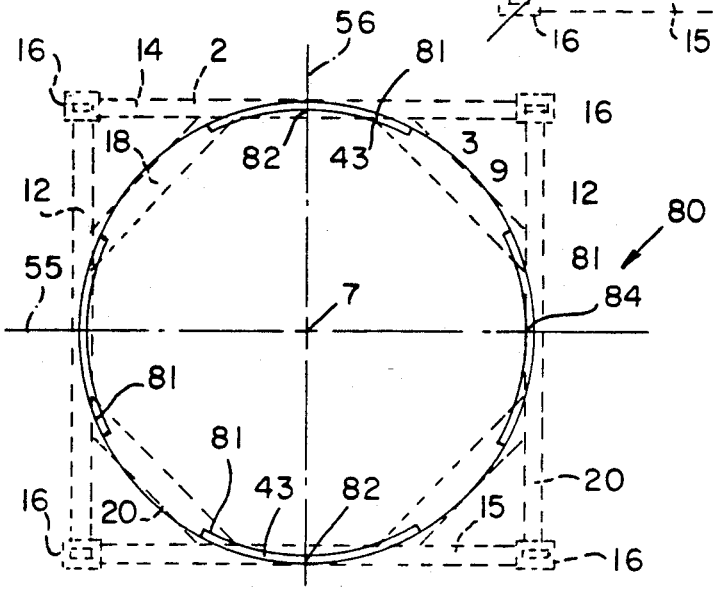
FIG. 12 is an end view similar to FIG. 3 of the container tank of FIG. 11.
Figure 11:
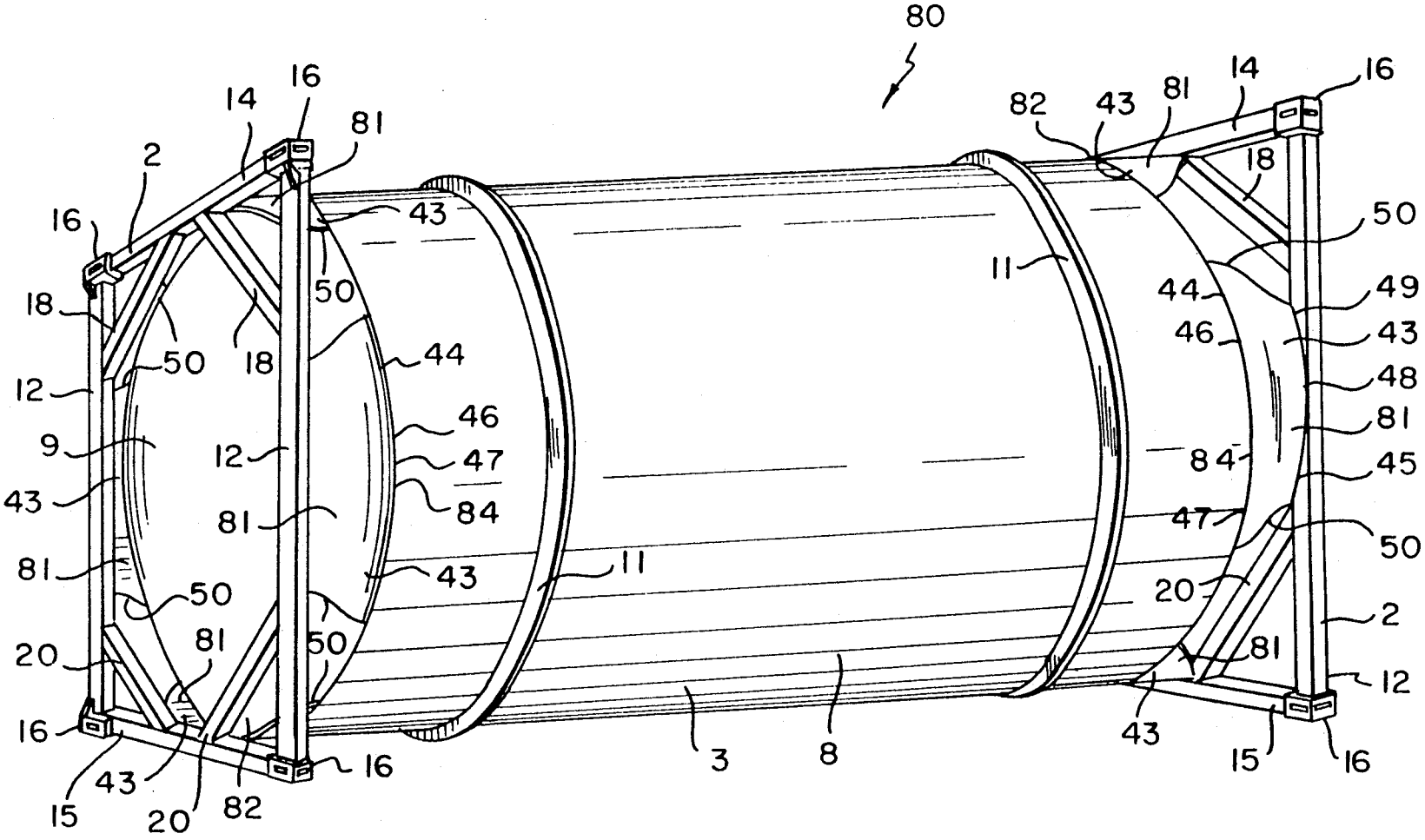
FIG. 11 is a perspective view similar to FIG. 1 of a container tank according to a still further embodiment of the invention.

Referring now to FIGS. 11 and 12 there is illustrated portion of a container tank according to a further embodiment of the invention indicated generally by the reference numeral 80. The container tank 80 is substantially similar to the container tank 1 and similar components are identified by the same reference numerals. In this embodiment of the invention, four bearer members 81 are provided for mounting the tank 3 to each adjacent end frame 2. Each bearer member 81 is formed by a bearer plate 43 identical to the bearer plates 43 of the container tank 1. The bearer plates 43 are positioned around the tank at top and bottom vertical positions 82 which co-incide with the central vertical plane 56 through the tank 3 and at side positions 84 which correspond with the central horizontal plane 55. The tank engaging edges 46 of the bearer plates 43 at the top and bottom vertical positions 42 extend equidistant from the vertical position 82 towards the horizontal plane 55 while the bearer plates 43 at the side positions 84 extend equidistant from the side position 84 towards the vertical plane 56. The frame engaging edges 48 of the bearer plates 43 are seam welded along seam welds 49 to the respective top and bottom cross members 14 and 15 and side members 12 of the end frames 2.

In all cases of the container tanks 70 and 80, the bearer plates 43 are welded along seam welds 47 to the tank 3 adjacent the seam weld 10 of the end caps 9 to the cylindrical shell 8 and are of similar curvature to the cylindrical shell 8. The bearer plates 43 are of similar cross section to the bearer plate 43 of the container tank 1 and accordingly define an axis of generation which co-incides with the longitudinal axis 7 of the tank 3.

Needless to say, the bearer plates may be provided in other positions between the tank and the end frames other than those illustrated in the drawings. Indeed, in certain cases, it is envisaged that the tank may be mounted to each end frame by a single bearer plate. In such cases, it is envisaged that two lower bearer members similar to the lower bearer members of the container tank of FIGS. 1 to 8 may be used in combination with the single bearer plate, however, this is not essential, in certain cases it is envisaged that a single bearer plate may be used in combination with any other bearer members of other construction or mounting members. In fact, it is envisaged that the tank may be mounted to each end frame by two bearer plates without any other mounting means or connecting means. Needless to say, while the tanks described with reference to FIGS. 9 to 12 have been described as being connected to each end frame by four bearer plates, the tanks may be connected by any other number of bearer plates, either more or less than four.

Needless to say, while it is preferable that the bearer plates and other bearer or mounting members should be symmetrically mounted around vertical and horizontal planes of the tank, this is not essential.

Needless to say, any other mix of bearer plates and bearer members whether comprising other bearer members may be used without departing from the scope of the invention. Indeed, in certain cases, it will be appreciated that the bearer plates may be provided at the lower portion of the tank while other bearer members or mounting members may be provided at the upper portion of the tank.

While it is preferable that the bearer plates should be of arcuate transverse cross section and of transverse curvature similar to the curvature of the central shell of the tank at which the bearer plates are mounted, firstly it is not essential that the transverse cross section of the bearer plates should be identical or substantially identical to the cross section of the central shell of the tank, and secondly, it is not essential that the bearer plates should be of arcuate cross section, the bearer plates may be of any other bent transverse cross section. For example, it is envisaged in certain cases that the bearer plates may be bent in transverse cross section to form an apex. Additionally, while it is preferable, it is not essential that the bearer plates should be bent along their entire length. However, it is important that the bearer plates should be bent at least adjacent the tank engaging end, and it will be appreciated that the transverse cross section of each bearer plate need not be constant along the entire longitudinal length of the bearer plate. For example, where the bearer plate is of curved arcuate shape along its entire length, the curvature of the transverse cross section of the bearer plate may vary along the longitudinal length of the bearer plate.

Further, it will be appreciated that while it is preferable it is not essential that the longitudinal side edges of the bearer plates should converge from the tank engaging end to the frame engaging end of the bearer plates and where the longitudinal side edges do converge from the tank engaging end to the frame engaging end, the shape of the longitudinal side edges may be of shape other than that described. For example, it is not necessary that the longitudinal side edges should be formed having a convex portion and a concave portion. The longitudinal side edges, in certain cases, may be relatively straight converging edges. In other cases, the longitudinal side edges may be straight parallel edges, in which case, the frame engaging edge of each bearer plate would be of similar length to the tank engaging edge. Indeed, in certain cases, it is envisaged that the tank engaging edge of each bearer plate may be shorter than the frame engaging edge.

Additionally, while it is preferable, it is not essential that the bearer plates should define an axis of generation which co-incides with the central longitudinal axis of the tank.

It will of course be appreciated that while the bearer plates and mounting members have been described as being welded to the tank and end frames, other suitable fixing means may be used. For example, the bearer plates and lower bearer members may be mounted to the tank and/or the end frames by bolts, screws, rivets or the like. In such cases, however, it is envisaged that suitable flanges would be provided to carry the bolts, screws or rivets. Although needless to say, other suitable means for carrying the bolts, screws and rivets may be provided.

While the tank has been described as comprising a central cylindrical shell, the central shell may be of any other cross section, for example, elliptical cross section, ovoid cross section or the like. In which case, it is envisaged that the curvature of the bearer plates would correspond to the curvature of the central shell of the tank adjacent the position where the bearer plates are secured to the central shell.

Needless to say, the tank may be provided with end caps of other shape and construction besides those described, and it will also be appreciated that end frames of other shape and construction may be provided without departing from the scope of the invention.

While the bearer plates, tank and mounting members have been described as being constructed of stainless steel material, any other suitable materials may be used without departing from the scope of the invention.

I claim:

1. A container tank comprising:

a tank, the tank comprising;

a central shell defining a central longitudinal axis and being of at least partly transverse arcuate cross section, and a pair of end caps closing respective ends of the central shell, at least one end frame extending transversely of the longitudinal axis adjacent one of the end caps, and mounting means for mounting the tank to the end frame, the mounting means comprising at least one bearer plate of plate material, each bearer plate extending in a generally longitudinal direction, parallel to said central shell axis, between the tank and the end frame, and having a transversely extending tank engaging end edge, and a longitudinally spaced apart transversely extending frame engaging end edge, the tank engaging end edge and the frame engaging end edge being joined by side edges, the tank engaging end edge of each bearer plate engaging an end of the tank adjacent the central shell at an arcuate portion thereof, and the frame engaging end edge engaging the end frame, each bearer plate being of arcuate transverse cross section, the transverse cross sectional curvature being constant between the end edges, and being substantially identical to the transverse cross sectional curvature of the central shell adjacent the tank engaging end edge.

2. A container tank as claimed in claim 1 in which each bearer plate engages the central shell of the tank.

3. A container tank as claimed in claim 1 in which the tank engaging end edge of each bearer plate is longer than the frame engaging end edge, and the tank engaging end edge and frame engaging end edge are joined by longitudinal side edges converging toward the frame engaging end edge.

4. A container tank as claimed in claim 3 in which each longitudinal side edge of each bearer plate comprises a convex portion extending from the tank engaging end edge towards a concave portion of the longitudinal side edge extending from the frame engaging end edge.

5. A container tank as claimed in claim 1 in which the tank engaging end edge of each bearer plate is seam welded over substantially its entire length to the tank and the frame engaging end edge is seam welded over substantially its entire length to the end frame.

6. A container tank as claimed in claim 1 in which a pair of end frames are provided extending transversely of the central longitudinal axis of the tank, the tank being mounted between the two end frames, and the tank being mounted to the end frames by respective bearer plates.

7. A container tank as claimed in claim 6 in which the tank is mounted to each end frame by a pair of bearer plates, the bearer plates being positioned on the tank at positions substantially halfway between a central horizontal plane and a central vertical plane of the tank, the tank engaging end edge of each bearer plate extending on each side of a 45° position intermediate the said central planes, respectively, towards the horizontal plane and the vertical plane.

8. A container tank as claimed in claim 1 in which the axis defined by the curvature of each bearer plate coincides with the central longitudinal axis of the tank.

9. A container tank as claimed in claim 1 in which the central shell of the tank is of circular cross section and each bearer plate is of partly circular transverse cross section.

* * * * *